US010151122B2

(12) United States Patent
Marks

(10) Patent No.: US 10,151,122 B2
(45) Date of Patent: Dec. 11, 2018

(54) ILLUMINATING LOCKS WITH MULTIPLE LIGHTS AND TOUCH-SENSITIVE SWITCH

(71) Applicant: Howard Marks, Portland, OR (US)

(72) Inventor: Howard Marks, Portland, OR (US)

( * ) Notice: Subject to any disclaimer, the term of this patent is extended or adjusted under 35 U.S.C. 154(b) by 82 days.

(21) Appl. No.: 15/249,747

(22) Filed: Aug. 29, 2016

(65) Prior Publication Data

US 2018/0058098 A1 Mar. 1, 2018

(51) Int. Cl.
*E05B 17/10* (2006.01)
*E05B 37/00* (2006.01)

(52) U.S. Cl.
CPC ..... *E05B 17/10* (2013.01); *E05B 37/00* (2013.01)

(58) Field of Classification Search
CPC ..... E05B 17/10
See application file for complete search history.

(56) References Cited

U.S. PATENT DOCUMENTS 4,293,894 A * 10/1981 Blank ..... E05B 17/10 362/100
4,777,570 A * 10/1988 Littles ..... E05B 17/10 362/100
5,057,975 A * 10/1991 Evigan ..... E05B 17/10 362/100
5,179,325 A * 1/1993 Aragon, Jr. ..... E05B 17/10 315/129
5,535,104 A * 7/1996 Maffey ..... E05B 17/10 315/84
5,611,226 A * 3/1997 Fata ..... E05B 17/10 362/100
5,634,710 A * 6/1997 Di Russo ..... E05B 17/10 362/100
6,278,366 B1 * 8/2001 Fletcher ..... E05B 17/10 315/149
6,305,814 B1 * 10/2001 Giamas ..... E05B 17/10 362/100
6,447,139 B1 * 9/2002 Wilkes ..... E05B 17/10 362/100
7,108,387 B1 * 9/2006 Lucas ..... E05B 17/10 200/61.62
7,832,887 B2 * 11/2010 Battle ..... E05B 17/10 362/100
2010/0219957 A1 * 9/2010 Jolley ..... E05B 17/10 340/600

* cited by examiner

*Primary Examiner* — Ismael Negron
(74) *Attorney, Agent, or Firm* — Mohr Intellectual Property Law Solutions, P.C.

(57) ABSTRACT

The locks includes a housing, a locking mechanism, a first illuminating element projecting light in a first direction to illuminate the locking mechanism, a second illuminating element projecting light in a second direction, a power source, and a touch-sensitive switch for selectively energizing at least one of the first and second light sources when actuated.

20 Claims, 10 Drawing Sheets

ILLUMINATING LOCKS WITH MULTIPLE LIGHTS AND TOUCH-SENSITIVE SWITCH

BACKGROUND

The present disclosure relates generally to locks with integral illumination. In particular, locks with integrated lights that can be toggled to illuminate a locking actuator or nearby object are described.

Known locks with integral illumination are not entirely satisfactory for the range of applications in which they are employed. For example, existing means of providing light for a user to operate a lock involve situating a light nearby so that light is cast onto an actuator such as a keyhole or other means. This requires situating the separate light nearby, which can require more time and effort to install. Or there may be times when there is no light nearby, or it is not functioning, and a user must operate a lock without adequate lighting. A separate light can be more difficult to place close enough to the actuator to provide effective illumination for a user, and may require more power or a larger light to effectively operate than a lighting element that is part of the lock. Providing an illuminating element for a lock actuator as part of the lock allows for more convenient installation, a greater ability to operate with less power, and easier user operation than conventional illuminated locks. In addition, providing a touch-sensitive means to toggle the light on and off allows for easier user operation than conventional illuminated locks. Providing a power source also makes it easier to integrate additional lights, such as an illuminating element to cast light on a nearby object such as a door knob.

Thus, there exists a need for locks with integral illumination that improve upon and advance the design of known illuminated locks. Examples of new and useful locks with integral illumination relevant to the needs existing in the field are discussed below.

SUMMARY

The present disclosure is directed to locking mechanisms with illuminating elements that are turned on and off by touch to illuminate the lock for easier use. The locks include a lock actuator, an illuminating element proximate to and capable of illuminating the actuator, a power source for the element, and a touch-sensitive switch that toggles power to the element on or off so that a user can illuminate the lock actuator by touch.

In some examples, the illuminated locks include a housing that contains a lock actuator, a lock mechanism, an illuminating element that illuminates the actuator, with the housing providing a touch-sensitive switch. In some further examples, the illuminated locks include a second illuminating element to illuminate an object proximate to the lock, such as a door knob. Some examples include a housing include a switch that may be toggled either by touch or some other means well-known in the art.

DETAILED DESCRIPTION

Figure 1:
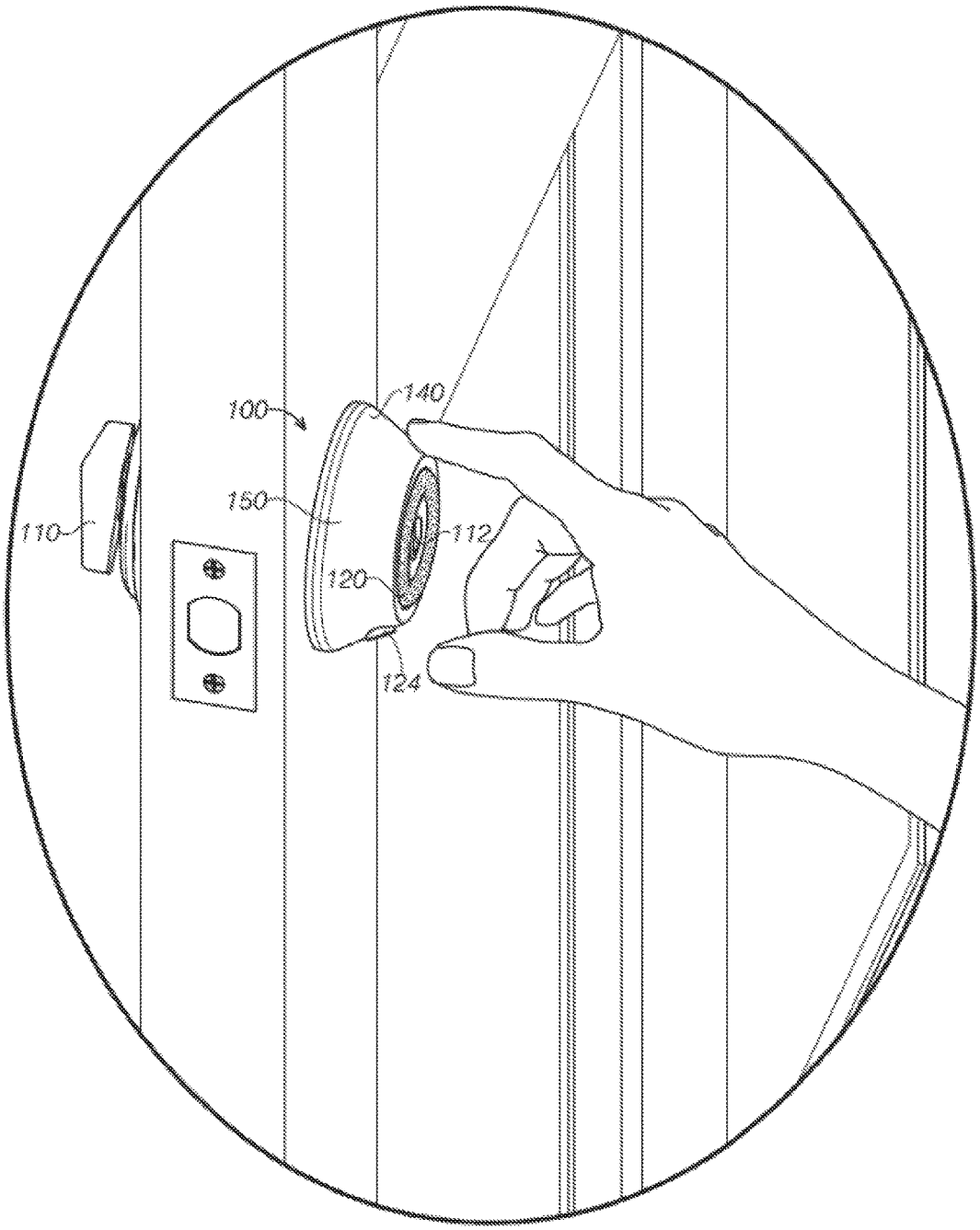
FIG. 1 is a perspective view of a first example of a lock with integral illumination, depicting the lock installed in a wooden door.

The disclosed locks with integral illumination will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various locks with integral illumination are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The disclosed locks with integral illumination provide an integrated light source to illuminate a keyhole, and separately or in addition an integrated light source to illuminate a nearby object, that can be turned on and off by touch. Some examples provide a push-button or a capacitive sensing area as a switch for the light. By providing an integrated light, a user can more easily operate the lock by seeing the lock actuator more clearly, whether the lock actuator is a keyhole, keypad, or the like. Existing lock illumination systems require a separate light be situated nearby in a way that illuminates the lock, which can require more time and effort to install, and which are often further away from the lock and thus can require more power to suitably illuminate the lock. The disclosed locks also provide a touch-sensitive housing so that users can easily turn the light on or off in the dark.

Lock with integral illumination 100 includes lock actuator 112, first illuminating element 120, second illuminating element 124, power source 130, and touch-sensitive switch 140. Some of the illuminated locks further include additional or alternative features, such as a housing, a keypad, a light composed of at least one LED, a light composed of a ring of LEDs, a timing mechanism, and a push-button or a capacitive sensing area acting as a power switch.

With reference to FIGS. 1-7, a first example of locks with integral illumination, illuminated lock 100, 400, and 500, will now be described. Some of the features in FIGS. 1-7 are the same or similar features as noted by the same reference numbers, unless expressly described otherwise. The reader will appreciate from the figures and description below that lock with integral illumination 100 addresses shortcomings of conventional locks.

As can be seen in FIG. 1, lock with integral illumination 100 is installed in a standard swinging door to secure or release, at the user's discretion, the door to a doorframe by means of a locking mechanism, in this case a deadbolt that is inserted or removed from the doorframe using lock actuator 112.

Figure 2:
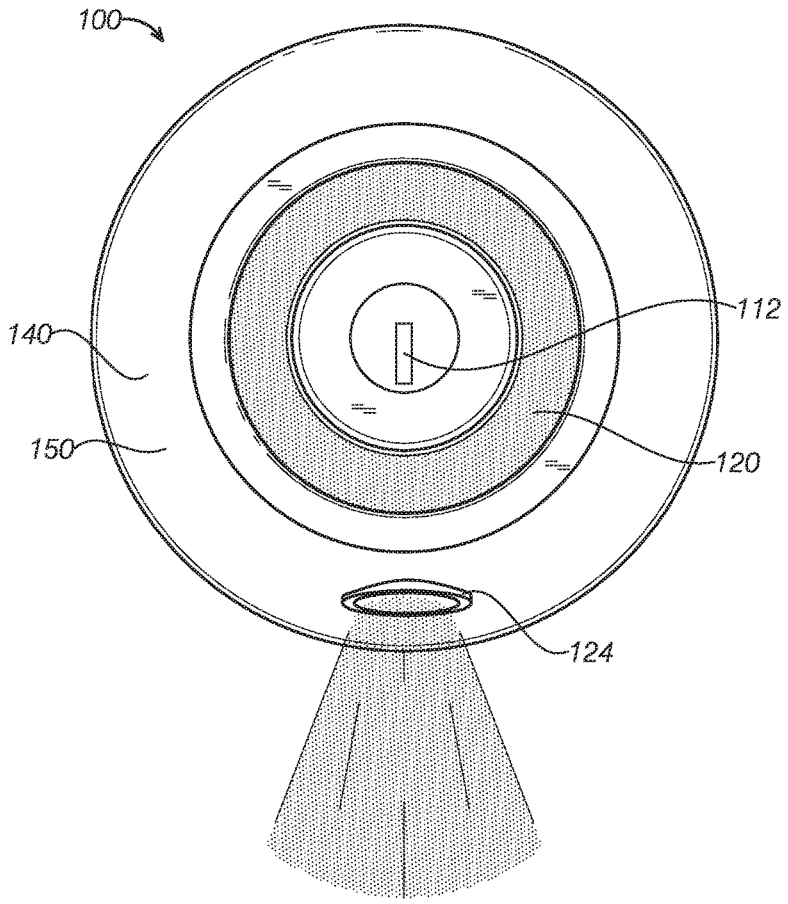
FIG. 2 is a front view of the lock with integral illumination depicted in FIG. 1.
Figure 3:
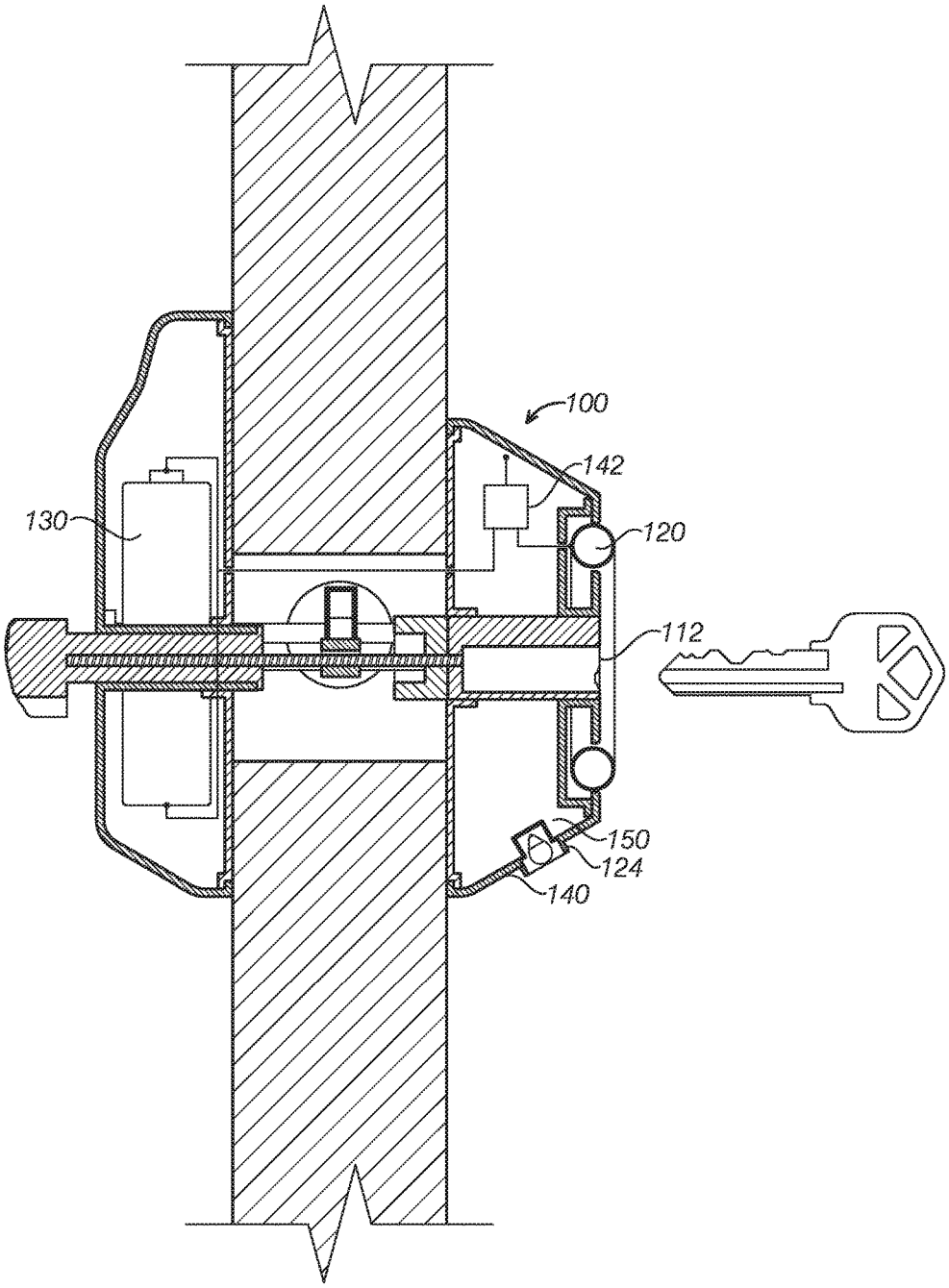
FIG. 3 is a side, cross-section view of the lock with integral illumination depicted in FIG. 1.
Figure 4:
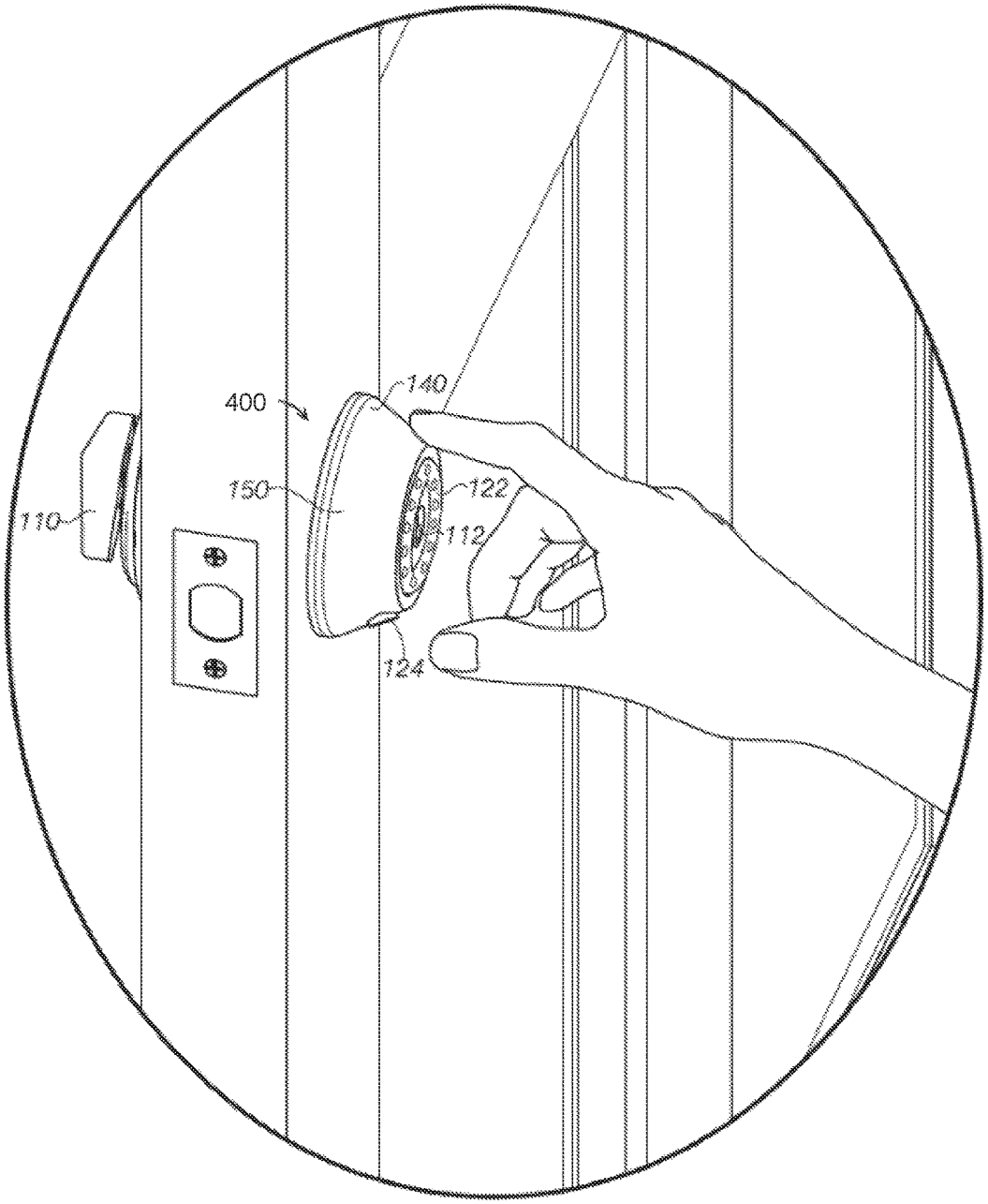
FIG. 4 is a perspective view of the lock with integral illumination depicted in FIG. 1, but showing LEDs as an illuminating element.

As shown in FIGS. 2 and 3, lock actuator 112 is a cylinder with a keyway that accepts a key and turns when the correct key is inserted. Turning the cylinder actuates a locking mechanism. It should be understood that any lock actuator can be used, according to the user's particular needs and desires, such as, for example, a keypad such as lock actuator 114 shown in FIGS. 5-7 by which a user enters a code instead of inserting and turning a physical key, or other examples such as remotely controlled mechanisms like those often found in an apartment building, key card readers, optical scanners, or fingerprint readers. Further, lock with integral illumination 500 may include an interior lock actuator, such as lock actuator 110 shown in FIG. 1, to allow for opening or closing the locking mechanism without the need for a key or code. It should be further understood that any lock mechanism can be used, such as a door knob with a lock to prevent its operation, an electromagnetic lock.

As can be seen in FIG. 2, first illuminating element 120 is a substantially circular light near to and encircling lock actuator 112. The first illuminating element provides light to illuminate the lock actuator and enhance a user's ability to see and use the lock actuator. In this example, first illuminating element 120 is situated close enough to the lock actuator that it provides a target for a user, the user can aim for lock actuator 112 by moving the key towards the center of first illuminating element 120.

As further shown in FIGS. 1-7, lock with integral illumination 100, 400, or 500 includes second illuminating element 124 located on the housing below the illuminating element's base that further directs light below illuminated lock 100, 400, or 500, respectively. That allows a user to situate an additional device, such as a doorknob, a sign, or anything else the user desires to illuminate below the lock. It should be understood that the light can be situated anywhere on lock with integral illumination 100 that the user desires so as to direct light in whatever direction the user desires, and can include multiple lights. Further, the light could be made as part of first illuminating element 120, for example with a hood molded into the element with a reflective material to direct where the user desires.

It should be understood that first illuminating element 120 can be composed of any suitable light source and be any suitable shape, according to the user's particular needs and desires. For example, it might be composed of a single light-emitting diode (LED) situated to cast light on the lock actuator, or fluorescent, incandescent, fiber optic, light pipe, or another other suitable means for casting light according to the user's particular needs and desires. FIGS. 4-7 illustrate first illuminating element 122 of the illuminated lock 400 in FIG. 4 and the illuminated lock 500 in FIGS. 5-7, respectively. First illuminating element 122 is a ring of LEDs encircling the lock actuator.

Figure 7:
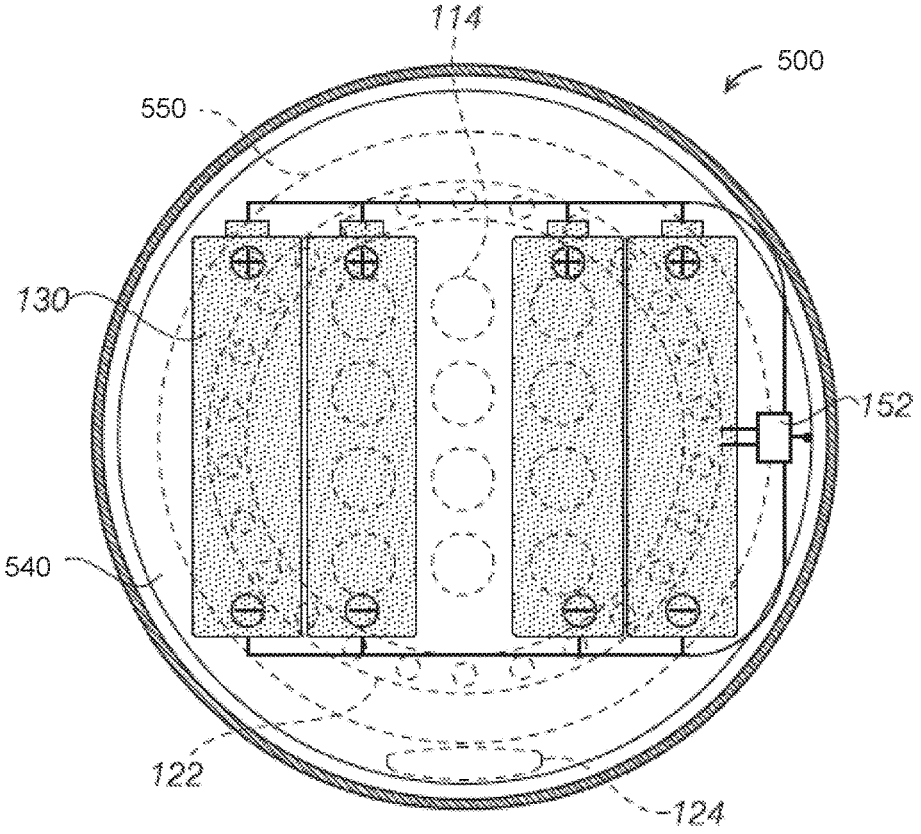
FIG. 7 is a cut-away rear view of the lock with integral illumination depicted in FIG. 5, showing a power source.

As illustrated in FIGS. 3 and 7, power source 130 supplies enough electricity to power the first illuminating element as well as the second illuminating element, each or both to the user's desired level. In this case, power source 130 uses four size AA batteries. It should be understood that any suitable power source can be used, according to the user's needs and desires such as, for example, different battery sizes, such as a 9V or AAA, or a different number of AA batteries, or a rechargeable battery with a solar power source to charge the battery when there is external light available, or even hard-wiring to an external electrical supply. Power source 130 is shown in electrical communication with first illuminating element 120 in FIG. 3, and with first illuminating element 122 in FIG. 7, and with touch-sensitive switch 140 or 540 in both FIGS. 3 and 7, respectively.

As can be seen in FIG. 3, touch-sensitive switch 140 toggles power on or off to first illuminating element 120, causing the element to light or turn off according to a design commonly known in the art. The switch can also be configured to dim or increase the light from the first illuminating element by modulating the power reaching it. It should be understood that any other means for toggling or modulating power can be used as well, such as, for example, a switch that senses when a key is nearby or touching the lock actuator, a key fob, wireless connectivity, or motion detectors.

Figure 5:
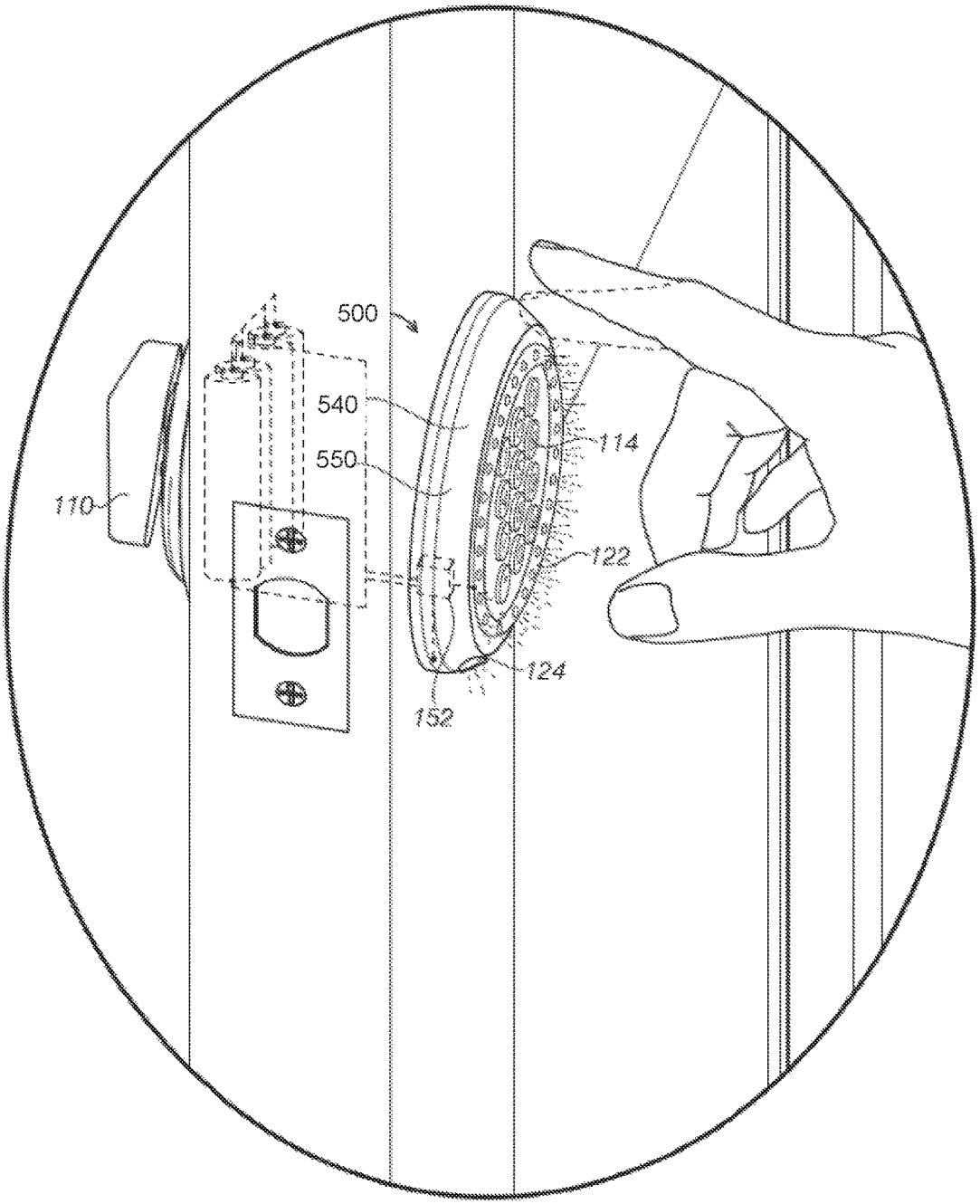
FIG. 5 is a perspective view of the lock with integral illumination depicted in FIG. 4, but showing a keypad as the lock actuator.
Figure 6:
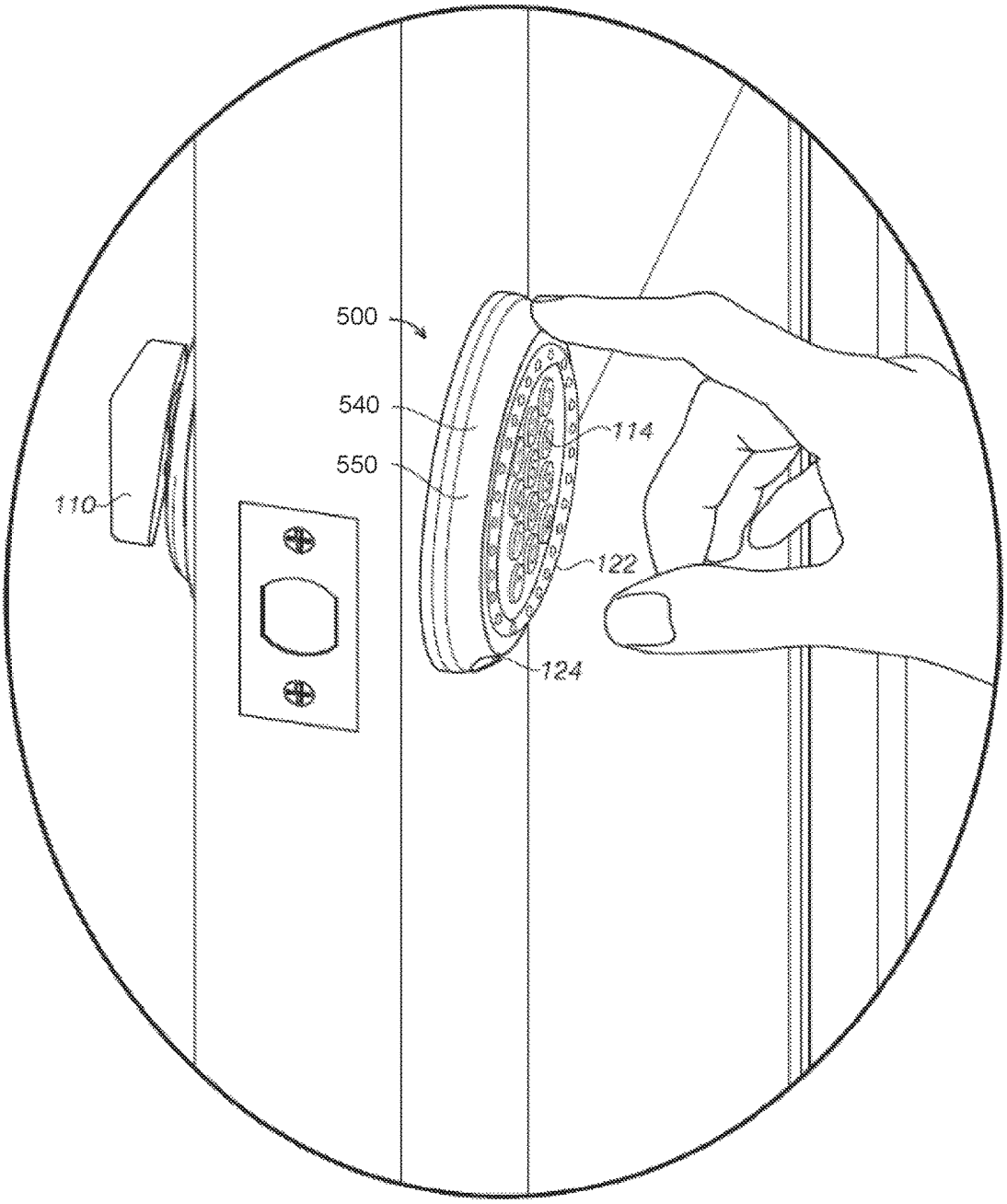
FIG. 6 is a perspective view of the lock with integral illumination depicted in FIG. 5, showing an illuminating element being turned off by touching the housing.

FIGS. 5 and 6 illustrate how touch-sensitive switch 540 is operated by a user's touch, such as with a finger, according to a design commonly known in the art. In other examples, touch-sensitive switch 540 might be a push-button, or any other suitable power switch. A lock with integral illumination could also be customized to energize only one, or both, illuminating elements as the user desires.

As can be seen in FIGS. 1 and 3, lock with integral illumination 100 includes housing 150. Housing 150 is a body, in this example encompassing lock actuator 112, first illuminating element 120, second illuminating element 124, power source 130, and touch-sensitive switch 140. In this example, housing 550 is connected to touch-sensitive switch 440, according to a design commonly known in the art, so that touching housing 550 operates touch-sensitive switch 440 and toggles power on or off to the first illuminating element, as illustrated in FIGS. 5 and 6.

It should be understood that in this example, housing 150 is made of a conductive metal but any suitable material can be used that functions to toggle the power source when touched. If a different switch mechanism is used, such as a push-button or a capacitive sensing area, other materials can be used that would not otherwise work to operate a touch-sensitive switch. In still further examples, housing 150 might be a capacitive sensing area acting as a switch according to a design commonly known in the art.

It should be further understood that lock with integral illumination 100 might not include a housing. For example, the lock might be contained entirely within a door, a cabinet, or other device the user wishes to lock or unlock, the component parts might be far apart without any housing at all, or there might be only some parts contained in a housing.

FIGS. 5 and 7 illustrate timing mechanism 152 contained within housing 150. Timing mechanism 152 is in electrical communication with power source 130 and housing 150. Housing 150 acts to energize the first illuminating element, shown as first illuminating element 122 in FIGS. 5 and 7, and second illuminating element 124, when touched according to a design commonly known in the art. Timing mechanism 152 operates, according to a design commonly known in the art, to deenergize the first and second illuminating elements after a predetermined period of time if the user does not manually deenergize it. The timing could also optionally be customized by the user.

Figure 8:
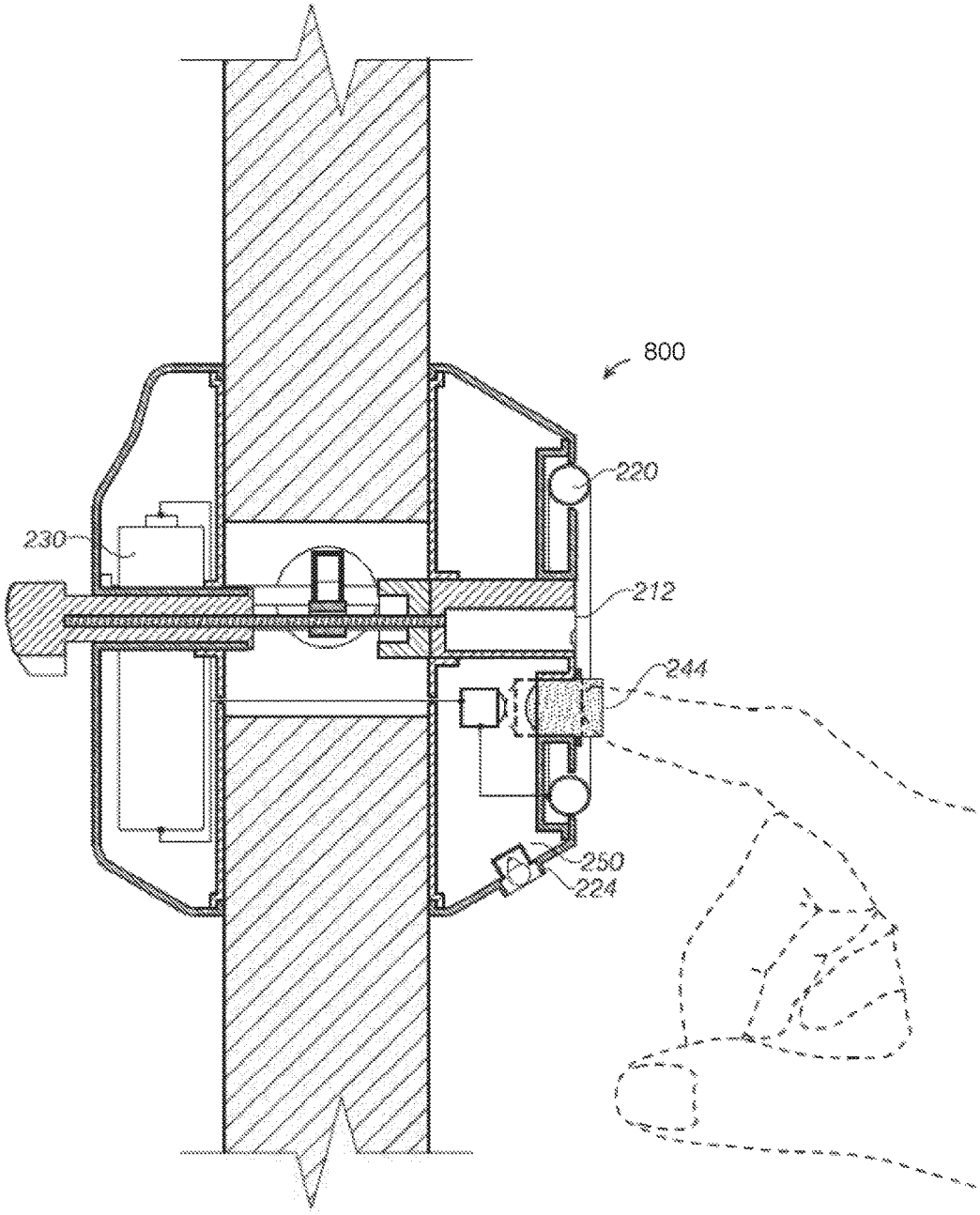
FIG. 8 is a side, cross-section view of a second example of a lock with integral illumination, depicting the lock installed in a wooden door with a pressure-sensitive button.
Figure 9:
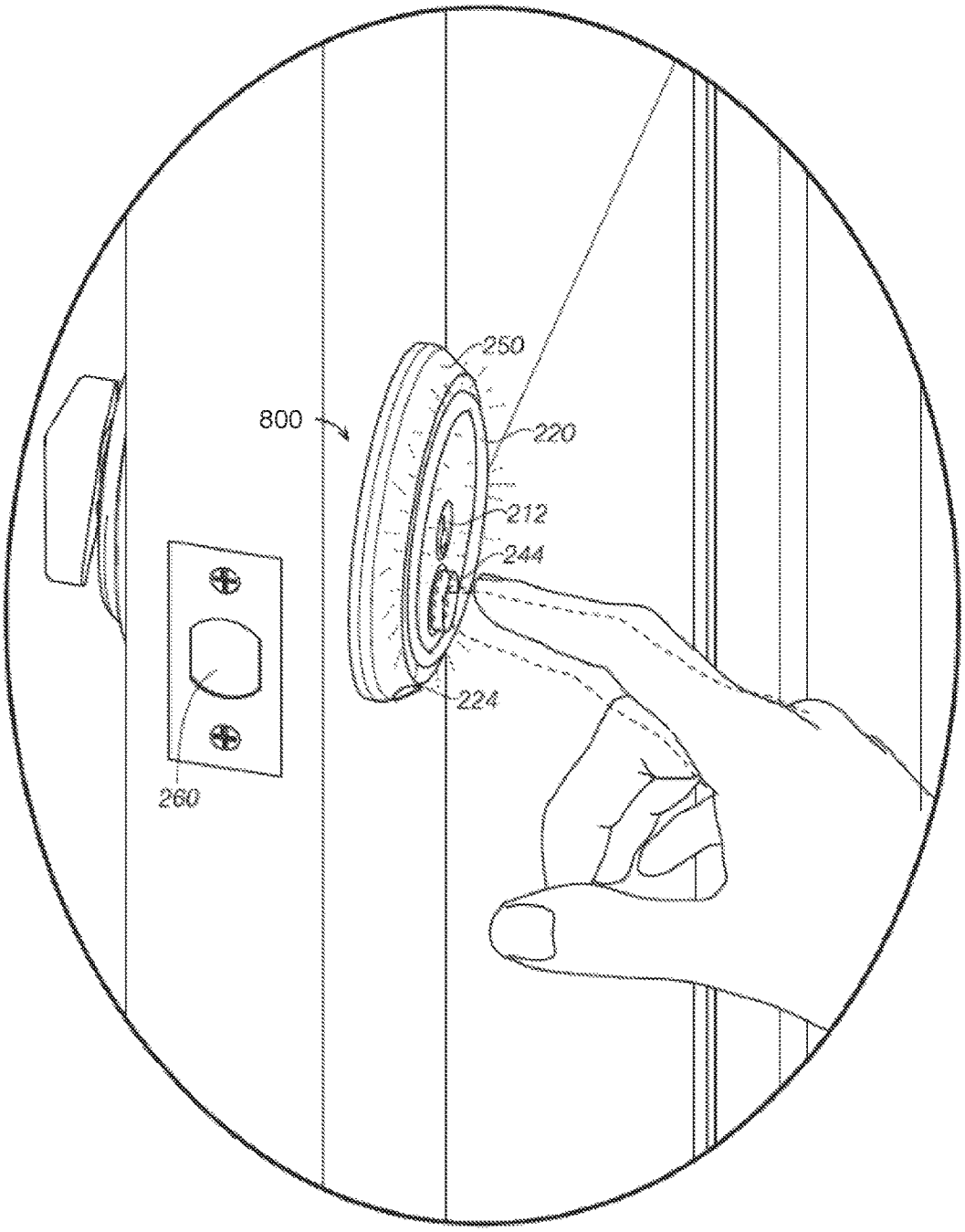
FIG. 9 is a perspective view of the lock with integral illumination depicted in FIG. 8.
Figure 10:
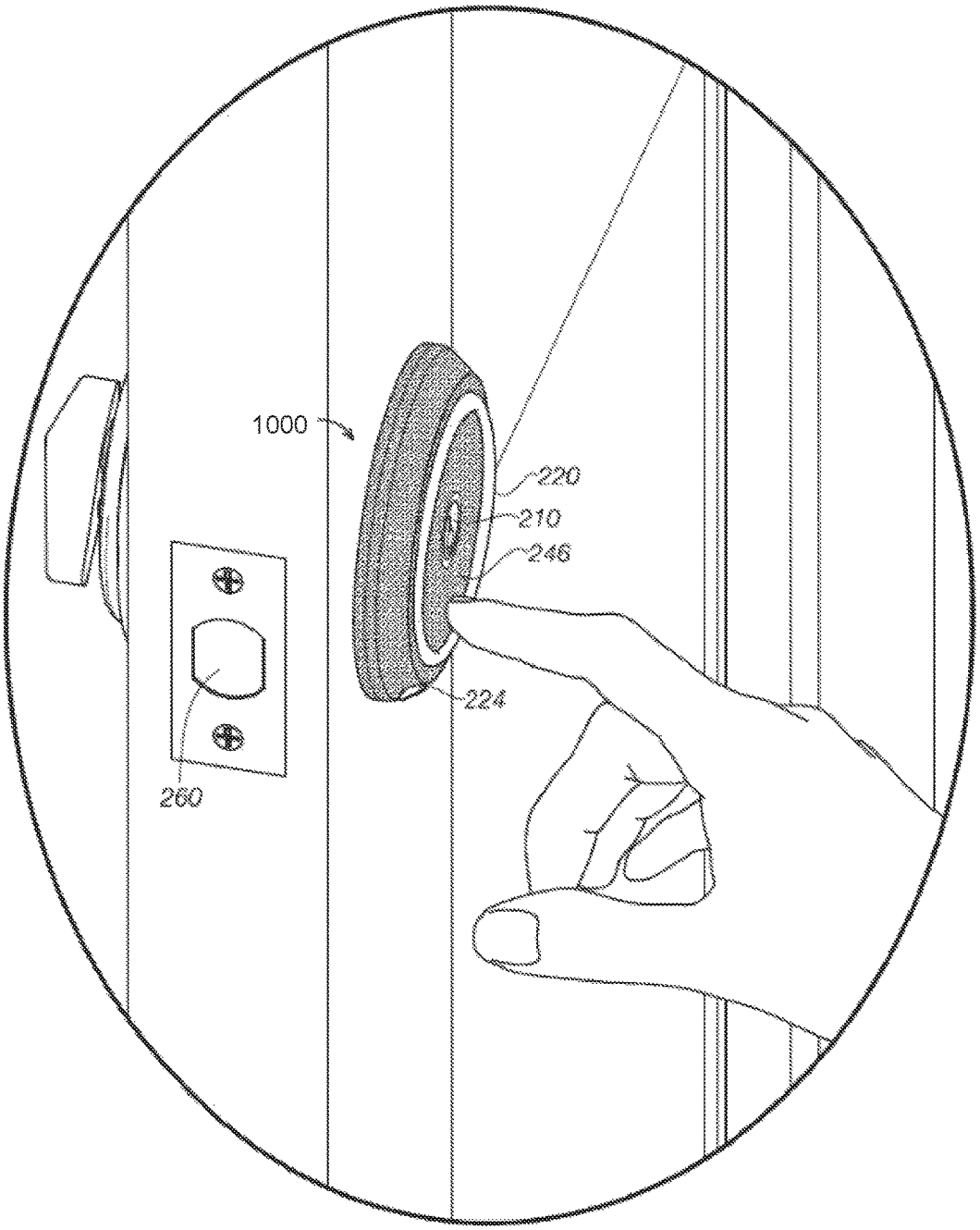
FIG. 10 is a perspective view of the lock with integral illumination depicted in FIG. 9, showing the housing as a capacitive sensing area without a pressure-sensitive button.

Turning attention to FIGS. 8-10, a second example of a lock with integral illumination, lock with integral illumination 800 in FIGS. 8 and 9 and the lock with integral illumination 1000 in FIG. 10 will now be described. Some of the features in FIGS. 8-10 are the same or similar features as noted by the same reference numbers, unless expressly described otherwise. Locks with integral illumination 800 and 1000, respectively, includes many similar or identical features as indicated by the same reference numbers. Thus, for the sake of brevity, each feature of locks with integral illumination 800 and 1000 will not be redundantly explained. Rather, key distinctions between locks with integral illuminations 800 (FIGS. 8-9) and 1000 (FIG. 10) and locks with integral illumination 100 (FIGS. 1-3), 400 (FIG. 4), and 500 (FIG. 5-7) will be described in detail and the readers should reference the discussion above for features substantially similar between the two locks.

Locks with integral illumination 800 and 1000 includes lock actuator 210, first illuminating element 220, second illuminating element 224, power source 230, housing 250, and lock mechanism 260. These elements are the same as with lock with integral illumination 100. Lock with integral illumination 200 illustrates the use of alternative power switches.

As can be seen in FIGS. 8 and 9, lock with integral illumination 800 can use switch 244. Switch 244 is a pressure-sensitive button that toggles a switch in electrical connection with the power source and the first and second illuminating elements according to a design commonly known in the art.

FIG. 10 illustrates lock with integral illumination 1000 and switch 246. Switch 246 is housing 250 composed of a capacitive sensing area. It acts to toggle a switch in electrical connection with the power source and the first and second illuminating elements according to a design commonly known in the art. In this example, switch 246 is installed in a standard swinging door with the portion that contains lock actuator 210, first illuminating element 220, and switch 246 exposed on one side of the door.

FIGS. 9 and 10 illustrate lock with integral illumination 1000 and locking mechanism 260. Locking mechanism 260 is a standard deadbolt that extends into a receiving hole in a doorframe when the door is closed, but can be any suitable mechanism including, for example, an electromagnetic device. Locking mechanism 260 is controlled by locking actuator 212 according to a design commonly known in the art. Locking actuator 212 is a cylinder that accepts a key, like locking actuator 112, but—just as with locking actuator 112—can be any other suitable device such as, for example, a keypad by which a user enters a code, such as lock actuator 114 illustrated in FIGS. 5-7, a fingerprint reader, or optical scanner.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A touch-illuminated lock, comprising:

a housing;

a lock actuator, wherein at least a portion of the lock actuator extends from the housing;

a first illuminating element disposed on an outer surface of the housing, wherein the first illuminating element is proximate to the lock actuator and capable of emitting light in a first direction;

a second illuminating element disposed on the outer surface of the housing, wherein the second illuminating element is proximate to the first illuminating element and capable of emitting light in a second direction;

a power source located within the housing, wherein the power source is capable of powering at least one of the first illuminating element or the second illuminating element; and a touch-sensitive switch in electrical communication with the power source, the first illuminating element, and the second illuminating element, wherein the touch-sensitive switch comprises a touch sensor integrated into the housing, wherein the touch-sensitive switch is configured to provide power to at least one of the first illuminating element or the second illuminating element when a user contacts the touch sensor.

2. The touch-illuminated lock of claim 1, wherein the touch sensor is a capacitive sensing area of the housing.

3. The touch-illuminated lock of claim 1, wherein the first illuminating element surrounds the portion of the lock actuator extending from the housing.

4. The touch-illuminated lock of claim 1, wherein:

the first illuminating element comprises at least one light emitting diode; or the second illuminating element comprises at least one light emitting diode.

5. The touch-illuminated lock of claim 1, wherein the lock actuator comprises conductive metal coupled to the touch sensor to sense a touch from the user.

6. The touch-illuminated lock of claim 1, wherein:

the first illuminating element is substantially circular in shape; and the first illuminating element is disposed proximate to and surrounding an opening of the lock actuator.

7. The touch-illuminated lock of claim 1, wherein the power source comprises a battery integrated into a cavity of the housing.

8. The touch-illuminated lock of claim 1, wherein the lock actuator comprises a keypad.

9. The touch-illuminated lock of claim 1, wherein the housing comprises a hood to direct the light emitted from the first illuminating element or the second illuminating element.

10. A touch-illuminated lock, comprising:

a housing, the housing containing:

a locking mechanism controlled by a lock actuator;

a first illuminating element disposed on an outer surface of the housing, wherein the first illuminating element configured to emit light in a first direction that illuminates the lock actuator when the first illuminating element is energized by a power source;

a second illuminating element disposed on the outer surface of the housing, wherein the second illuminating element is configured to emit light in a second direction; and a touch sensor configured to provide power to at least one of the first illuminating element or the second illuminating element when a user touches the housing.

11. The touch-illuminated lock of claim 10, wherein the housing further comprises a cavity to store the power source for energizing at least one of the first illuminating element or the second illuminating element.

12. The touch-illuminated lock of claim 10, wherein:

the first illuminating element comprises at least one light emitting diode; or the second illuminating element comprises at least one light emitting diode.

13. The touch-illuminated lock of claim 10, wherein:

when the touch sensor receives a first touch from the user, the touch sensor provides power to at least one of the first illuminating element or the second illuminating element; and when the touch sensor receives a second touch from the user, the touch sensor ceases provides power to at least one of a first illuminating element or the second illuminating element.

14. The touch-illuminated lock of claim 10, wherein:

the lock actuator comprises a user interface integrated into the housing; and the first illuminating element is disposed around the user interface.

15. The touch-illuminated lock of claim 14, further comprising a timing mechanism to stop at least one of the first illuminating element or the second illuminating element from receiving power after a period of time.

16. A device, comprising:

a locking mechanism controlled by a locking actuator;

a first illuminating element disposed on an outer surface of the housing, wherein the first illuminating element is configured to emit light in a first direction to illuminate the locking actuator when the illuminating element is energized;

a second illuminating element disposed on the outer surface of the housing, wherein the second illuminating element is configured to emit light in a second direction to illuminate an object at a location different than the locking actuator;

a power source located within the housing;

a switch in electrical connection with the power source and the illuminating element wherein switch comprises a touch sensor integrated into the housing; and a housing comprising a cavity to hold the locking mechanism, locking actuator, illuminating element, power source, and switch, wherein toggling the switch causes the power source to energize and de-energize at least one of the first illuminating element or the second illuminating element.

17. The device of claim 16, wherein the switch is toggled by a user making contact with the touch sensor.

18. The device of claim 16, wherein the switch is toggled by a user making contact with a capacitive sensing area of the housing.

19. The device of claim 18, wherein the capacitive sensing area is a conductive metal portion of the housing.

20. The device of claim 18, wherein the housing is installed within a door, with a portion of the housing including the lock actuator, the first illuminating element, the second illuminating element, and capacitive sensing area extending from a side of the door.

* * * * *